US005954279A

United States Patent [19]

Siegfried et al.

[11] Patent Number: 5,954,279

[45] Date of Patent: Sep. 21, 1999

[54] CUTTING MECHANISM OF A DOCUMENT SHREDDER

[75] Inventors: Huebner Siegfried, Wittenhofen; Bruno Lang, Bermatingen, both of Germany

[73] Assignee: Schleicher & Co. International Aktiengesellschaft, Markdorf/Bodensee, Germany

[21] Appl. No.: 09/047,690

[22] Filed: Mar. 25, 1998

[30] Foreign Application Priority Data

Mar. 26, 1997 [GB] United Kingdom ..... 197 12 661

[51] Int. Cl.[6] ..... B02C 18/16

[52] U.S. Cl. ..... 241/166; 241/236

[58] Field of Search ..... 241/236, 166, 241/167

[56] References Cited

U.S. PATENT DOCUMENTS

| | | | |
|---|---|---|---|
| 4,809,916 | 7/1989 | Schwelling | 241/166 |
| 5,636,801 | 6/1997 | Kroger | 241/167 |

FOREIGN PATENT DOCUMENTS

| | | |
|---|---|---|
| 2526109 | 1/1978 | Germany . |
| 3539503 | 1/1989 | Germany . |
| 3631362 | 6/1989 | Germany . |
| 4008654 | 9/1991 | Germany . |
| 4106792 | 8/1992 | Germany . |
| 4123293 | 1/1993 | Germany . |
| 3631363 | 1/1995 | Germany . |
| 2 167 316 | 5/1986 | United Kingdom . |

*Primary Examiner*—Mark Rosenbaum
*Attorney, Agent, or Firm*—Quarles & Brady LLP

[57] ABSTRACT

As the stripper (20) for the cutting mechanism (13) of a document or paper shredder (11) is provided a plastic part, which can be injection moulded in one piece and entirely surrounds the shaft (18) of the cutting rollers (15) in the gap (17) between the cutting disks (16). In the overlap area (23) between the two cutting disks is provided a thin, flexible stripper web (24), which makes it possible to open the separation point (36) of the stripper separated with respect to the flexible circumferential portion (24) to such an extent that it can be snapped over the shaft (18). The stripper can be manufactured as a single component or as a stripper block with several to all the strippers of a cutting roller. This leads to a low friction stripper preventing cut particles winding round the shaft.

10 Claims, 3 Drawing Sheets

CUTTING MECHANISM OF A DOCUMENT SHREDDER

FIELD OF APPLICATION AND PRIOR ART

The invention relates to a cutting mechanism of a document shredder with two parallel, cooperating, driven cutting rollers, in which each cutting roller alternately and in axially spaced manner has cutting disks and shaft sections in the gap thereof, the cutting disks of the in each case other cutting roller engaging in the gap between the cutting disks, and with at least one stripper, which engages in the gap and completely surrounds the shaft section.

Document or paper shredders, which also cover all comminuting devices acting in a cutting manner for written or unwritten documentation or other flat materials, draw the material to be comminuted between the cutting rollers and cut it into strips or, with a correspondingly toothed or slotted construction of the cutting disks, into individual particles.

DE 25 26 109 B discloses cutting mechanism, in which strippers comprising punched sheet metal blanks are provided, which completely surround the shaft section in the gap between the cutting disks. In order to apply them to the cutting rollers, it is necessary to assemble said rollers from a central shaft and rows of circular disks and spacers thereon. This is expensive and, as a result of the lower bending strength of such an assembled structure, requires larger cutting shaft diameters. Therefore such constructions have scarcely been used and have been replaced by one-piece cutting rollers.

DE 40 08 654 A discloses a cutting mechanism operating with shearing or torsional cutting, with strippers of comb-like plastic injection moulded blocks in one piece with the casing. The strippers only surround a small circumferential portion of the cutting roller between the stripper edges or blades running on said rollers. To prevent penetration of particles between shaft and stripper, they would have to scrape or slide on the shaft section and would consequently increase power consumption. However, it would frequently be impossible to prevent such strips or particles winding round the shaft, which would also increase power consumption.

DE 17 61 025 C discloses a stripper system, which for each cutting roller comprises in each case a "tunnel", assembled optionally from two parts, made from sheet metal and surrounding the entire cutting roller and which in the engagement area of said cutting rollers has slots from which the cutting disks project. Particles which have passed through the slots can collect in the "tunnel".

OBJECT AND SOLUTION

The object of the invention is to provide a cutting mechanism of the aforementioned type, which is constructed in a simple and easily manufacturable manner and operates with a low power consumption and without any risk of blockages by particles.

According to the invention this problem is solved in that the stripper is separated at at least one separation point of its circumference surrounding the shaft section and is joinable. Such a stripper can be subsequently fitted to a finished cutting roller, which is e.g. made from one piece by puncturing the gaps. In a two-part construction of the stripper surrounding the shaft section in the gap, it can be joined by means of orienting and engagement parts and secured in that pins engaged through the bore are joined by ultrasonic welding or similar joining measures.

Particular preference is given to a construction in which the stripper is only split or separated at one point of its circumference and a portion of its circumference is constructed in flexible or hinge-like manner. As a result the stripper with its two plate-like stripper sections can be so bent apart that it can be engaged over the shaft section. The flexible section then acts like a film hinge and allows the opening of the mouth forming at the separation point. Subsequently the two lateral sections of the stripper are brought together again at the separation point, where by the orientation and engagement parts, e.g. cooperating V-recesses or matching projections and depressions, they ensure that the stripper opening surrounding the shaft section acquires its circular shape. The engagement parts can also be constructed in interlocking manner, e.g. snapping in under pressure.

In particularly preferred manner the strippers are manufactured as plastic injection mouldings, being moulded in the slightly opened position in order to shape the separation point and engagement parts. By corresponding shaping it is possible to ensure that the stripper opening acquires a circular shape in the compressed condition.

For the operation of the cutting mechanism and in particular the stripping function, it is particularly advantageous if the stripper has, considered in the radial direction of the cutting rollers, a thin circumferential portion in the engagement area of the in each case facing cutting rollers. Thus, despite a slight weakening of the cutting roller, there is a large cutting disk overlap in the puncturing area of the stripper completely surrounding the cutting roller. This area can simultaneously be the flexible portion for creating the hinge effect.

For the unity of the stripper and/or the fixing of the stripper to the machine-fixed parts of the cutting mechanism, a separate connecting part or such a part integrated into the casing, e.g. a U or C-rail can be provided, in which engage the correspondingly constructed stripper sections. In this area the stripper also has connecting webs, which in the case of individual stripper elements (one stripper per cutting disk gap) can also serve as spacers between the individual strippers and correspondingly have a thickness corresponding to one cutting disk spacing or division, whilst the actual strippers can be constructed with a smaller thickness than the spacing between the cutting disks. They therefore run in friction-free manner between the cutting disks. Preferably there is only a somewhat thicker shoulder in the immediate circumferential area of the stripper opening, which runs close to the cutting disks. This is sufficient for the stripping action.

Preferably, several juxtaposed strippers of a cutting roller are combined into a block extending axially to the cutting roller and can consequently be manufactured in one piece as plastic injection mouldings. In this case the connecting webs, which can be positioned on either side of the separation point, form through connections, form which the strippers project in comb-like manner. Such a block can then be opened as a whole as a result of its flexible sections and snapped over the shaft. It is consequently possible to jointly manufacture and fit stripper blocks with a larger number of strippers. Thus, optionally the stripper for a cutting roller could be made from one piece. Such a construction is also possible with strippers made in two parts, in that the stripper is assembled from two combs in each case containing the stripper half-shells and these are joined together.

Manufacture from plastic also makes it possible to use a particularly readily sliding plastic, which keeps the power consumption low and prevents heating by friction. The fact that the stripper completely surrounds the shaft does not make it necessary for the stripper opening to be in direct frictional contact with the shaft section, because there is no need for stripper edges or blades, which must scrape off the particles. In fact the stripper surrounding the shaft ensures that the particles do not arrive at the shaft base.

Adjacent to the thin stripper section in the radial direction can be provided plate-like stripper elements, which also project over the outer cutting disk circumference and consequently prevent particles being drawn into the gap. It is particularly advantageous if said section forms arms on which it is possible to engage manually or by means of an assembly tool during the assembly process, so as to be able to open the stripper in the vicinity of its separation point and snap it over the shaft.

These and further features can be gathered from the claims, description and drawings and the individual features, either singly or in the form of subcombinations, can be implemented in an embodiment of the invention and in other fields and can represent advantageous, independently protectable constructions for which protection is hereby claimed. The subdivision of the application into the individual sections and also the intermediate headings in no way restrict the general validity of the statements made thereunder.

BRIEF DESCRIPTION OF THE DRAWINGS

An embodiment of the invention is described hereinafter relative to the attached drawings, wherein show.

DESCRIPTION OF PREFERRED EMBODIMENTS

Figure 1:
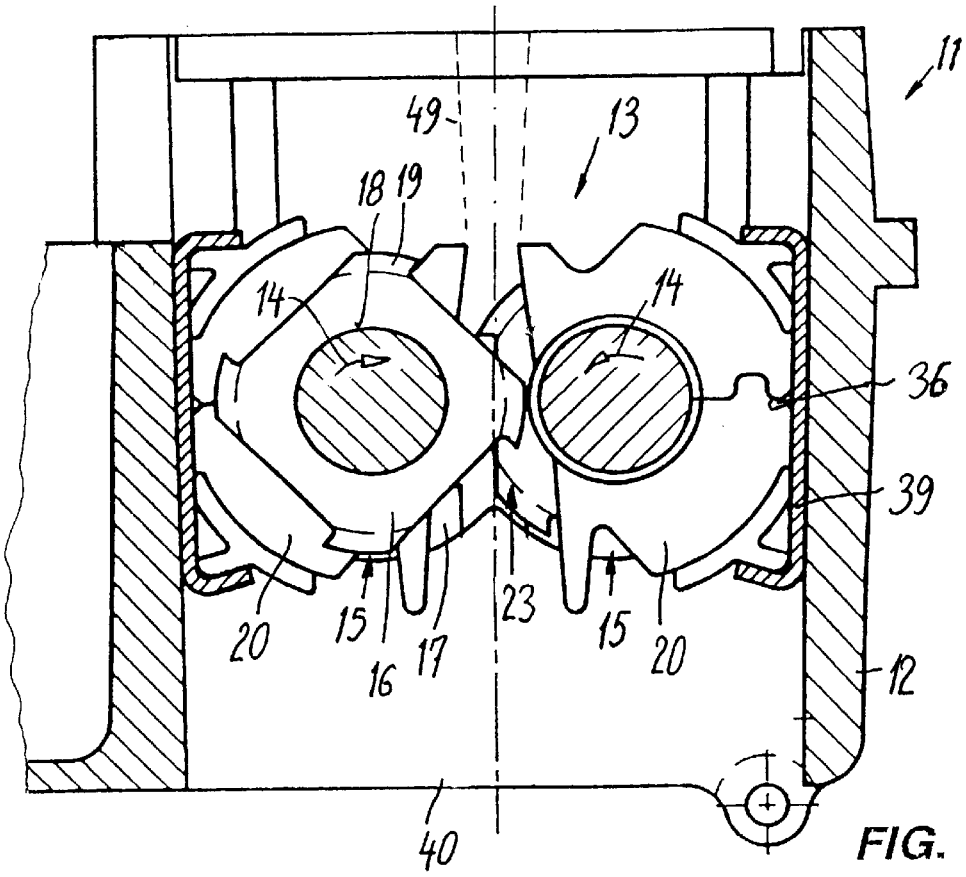
FIG. 1 A section through a document shredder and its cutting mechanism.

FIG. 1 shows a paper or document shredder 11 with a casing 12 housing a cutting mechanism 13. It comprises two juxtaposed cutting rollers arranged in parallel, horizontal manner, which are rotated in opposition by a not shown motor by means of a synchronizing gear (cf. rotation direction arrow 14).

The cutting rollers 15 are made from solid steel material and have cutting disks 16 separated by gaps 17. In this area the cutting roller diameter is reduced to a shaft section 18, whose surface forms the base of the punctured opening or gap 17.

The cutting disks 16 have in the present embodiment projecting cutting teeth 19, which are constructed in sawtooth-leading manner for better engagement in the material to be cut. Between the cutting teeth the cutting disk is flattened in chord-like manner, so that it forms a square base shape with the cutting teeth at the four corners. This cutting disk type is provided for a document shredder with particle cut, i.e. the strips cut by the cooperating cutting disks are simultaneously also longitudinally torn, so that the material to be shredded is on the one hand made particularly unidentifiable and on the other the packing density of the particles is greater than with strip cut. However, the invention is also suitable for cutting mechanism with strip cut, the cutting disks usually being circular disks with a surface roughening improving the drawing in of material.

The cutting rollers 15 are so arranged with respect to one another that the cutting disks 16 of one cutting roller in each case engage in the gap 17 of the other cutting roller. In all there are numerous cooperating cutting disks and gaps for each cutting roller. As a function of the intended use and security level, the division or spacing is between 4 and 8 mm, so that the strips or particles are cut with a width between 2 and 4 mm. For mere comminution without any need to render unidentifiable, it is possible to have larger spacings, as well as smaller spacings when particularly high security is required. The interengaging cutting disks form between them a cutting gap or engagement area 23, to which the material to be comminuted is supplied by means of an introduction slot 49.

A stripper 20 is located in each of the gaps 17. This stripper, which could also be called a rejector, is made from a substantially plate-like plastic part (cf. particularly FIG. 2), which surrounds a circular stripper opening 21. In this immediate circumferential area is axially provided (transversely to the drawing plane) a somewhat thicker shoulder 22, whose thickness corresponds to the axial dimensions of the gap 17, i.e. is only smaller by a tolerance permitting sliding. In a lower circumferential portion 24 adjacent to the engagement area 23 (cf. FIG. 2), only the shoulder 22 surrounds the opening 21 by 360°. Thus, in this flexible section 24 of the stripper, which is rather long in circumferential direction and in axial direction nearly as wide as the space 17, but only thin-walled and flexible in the radial direction. Therefore and due to the elastic properties of the plastic material it can be elastically bent considerably in a radial plane without impairing the material properties or permanent deformation.

On either side are connected facing the shoulder 22 in the axial direction thinner, plate-like stripper sections 25, 26, whose circumference partly projects over the outer circumference of the cutting disks. Directly connecting on to the flexible circumferential portion 24, they form inlet and outlet stripper edges 27, 28, which over and beyond the cutting disk circumference form arms 29, 30, which are demarcated from the remaining stripper sections by notches 31, 32. Thus, a second stripper edge is in each case formed in the forward movement or return movement direction of the cutting mechanism and the resulting arms, in a manner to be described hereinafter, also permit the gripping of an assembly device for opening the stripper.

On the outer circumference of the stripper sections 25, 26 are provided connecting elements 33, 34, which project axially and bilaterally over the stripper sections 25, 26. Their axial thickness corresponds to the spacing of the cutting disks, so that juxtaposed strippers are supported on one another by means of the connecting elements. They are shaped like circular ring segments with outwardly projecting noses 35.

Figure 2:
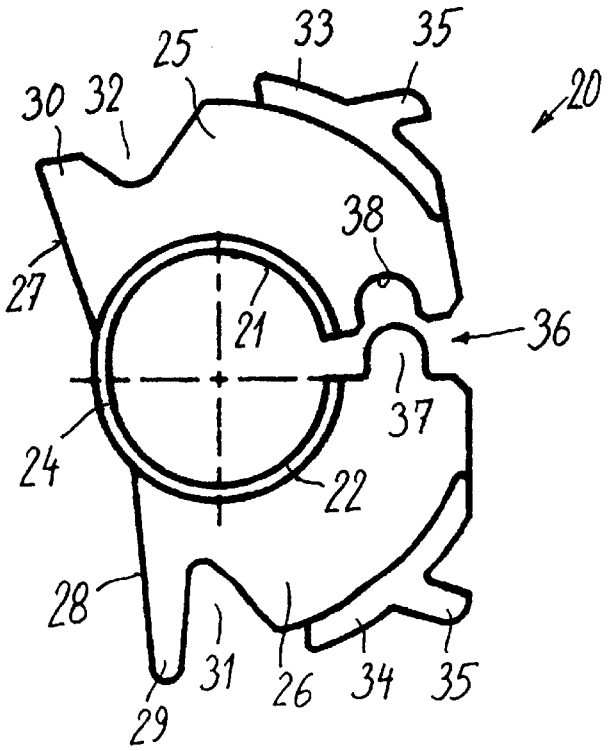
FIG. 2 A view of the stripper used therein.
Figure 3:
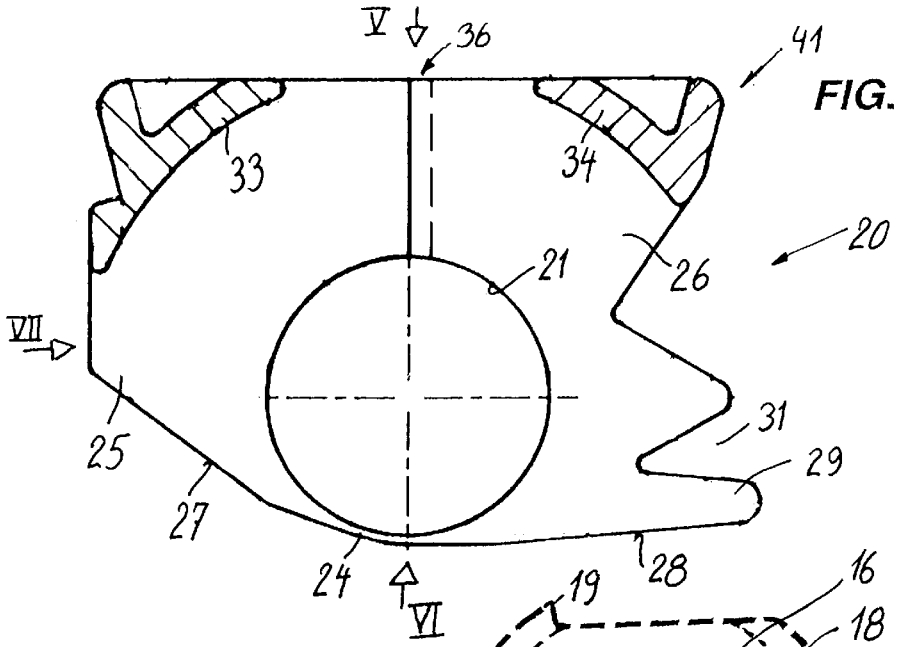
FIG. 3 A cross-section through a stripper block.

Roughly diametrically facing the flexible circumferential portion 24, the stripper has a separation point 36, which interrupts and separates from one another in a roughly radial direction the two stripper sections 25. In the vicinity of the separation point are provided orientation and engagement parts 37, 38, which in the present case comprise a somewhat more than semi-circular groove and a corresponding projection in the separating face. FIG. 2 shows the stripper in a form such as is assumed at the time of manufacture and mounting. The separation point 36 is opened, so that the stripper can be manufactured in one piece in a plastic injection mould. Corresponding to the circumferential spacing, which is provided between the associated surfaces of the separation point, the opening 21 is made non-circular, so that a circular shape is only obtained when the two faces of the separation point are compressed. The flexible circumferential portion 24 acts in the manner of a film hinge and permits a much larger opening of the separation point, but in the circumferential direction its length is such that the plastics material is not permanently deformed or damaged.

For the installation of the stripper on the cutting rollers, the stripper 20 shown in FIG. 2 is grasped singly or as a plurality by an assembly device or by hand, the arms 29 and 30 being able to act as gripping points. The separation point 36 is further opened (cf. also FIG. 4) so that the "mouth" formed by the separation point 36 is sufficiently large for the stripper to be engaged over the shaft section 18. It then partly automatically snaps together again and accompanied by the locking of the orientation and engagement parts 37, 38 a closing together effect is obtained. They can be so constructed that they lock together e.g. under snap action. The connecting elements 33, 34 are then introduced by their noses 35 into a connecting art 39 in the form of a slightly dovetail-shaped metal rail (U or C-shape) and fixed accompanied by secure closing of the separation point 36. By a corresponding dimensioning of the thickness of the connecting elements 33, 34 a certain axial mobility can be maintained, so that a precision adaptation to the tolerances of the cutting rollers is possible.

The connecting part can also be formed by one or more rods, e.g. square rods, which can penetrate and/or guide the strippers.

After the strippers have been mounted on the cutting rollers, they are installed in a casing, the connecting parts 39 being mounted in machine-fixed manner on or integrated into the casing or a cutting mechanism chassis. If a chassis is provided, the connecting parts can form the chassis longitudinal struts or supplement the latter. FIG. 1 shows that as a result of the very thin construction of the flexible circumferential portion 24 there can be a very extensive engagement of the cutting disks 16 or its teeth 19 in the gap 17, without the gap having to be excessively deeply punctured, which would lead to a weakening of the shaft section 18. Particularly in the case of particle cutting the penetration depth is very important, so that also in the case of very flexible comminution materials a reliable separation can be ensured.

After being longitudinally cut between the cooperating cutting disks of both rollers and through the alternation of teeth and gap separated in the transverse direction, the separated particles or strips do not pass to the base of the shaft sections 18, so that they cannot adhere there and be drawn round the shaft. The stripper edges 28 ensure in the operating direction 17 that no particles, adhering to the cutting disks, are also drawn round the gap. Due to the narrow shoulder or rim 22, which covers the space 17, and the plate-like sections 25, 26 which a greater distance from the cutting disks, a good stripping effect is combined with low friction. If any particles should slide past the stripper edge 28 and arm 29, there is a certain probability that after passing through the notch 31 it would be stripped by the following edge and dropped downwards out of the opening 40. The same effect is exerted by the stripper edge 27, arm 30 and notch 32 on the entrance side of the cutting mechanism, if the latter is driven rearwards, e.g. for clearing a blockage.

FIGS. 3 to 7 show a stripper construction which, except for the differences described hereinafter, coincides with FIGS. 1 and 2, so that reference is made to the description of the latter.

FIGS. 3 to 7 show a stripper block 41, which contains numerous strippers 20 arranged in parallel, comb-like manner. In the present case it is a block extending over the entire length of the cutting roller, e.g. having forty strippers. The individual stripper sections 25, 26 are adapted as regards thickness, but with a friction-reducing tolerance, to the axial width of the gap 17. Therefore there is no projecting shoulder 22 around the opening 21, so that the flexible circumferential portion 24 is constructed with the same axial thickness as the stripper sections 25, 26. The exit-side stripper section 26 has a second notch in addition to the notch 31, which gives rise to a third stripper edge.

The connecting elements 33, 34 are constructed as connecting webs passing over the entire stripper block length and consequently in each case form the back of a comb, which contains as comb teeth the stripper sections 25, 26, which are interconnected via the flexible section 24. With a slight lateral displacement, the separation point 36 roughly diametrically faces the apex of the flexible section 24. Its orientation and engagement parts 37, 38 are constructed as a radially directed, V-shaped groove and projection (FIG. 5), so that in the case of the mutual engagement thereof an equiplanar alignment of the stripper sections 25, 26 is ensured.

Figure 4:
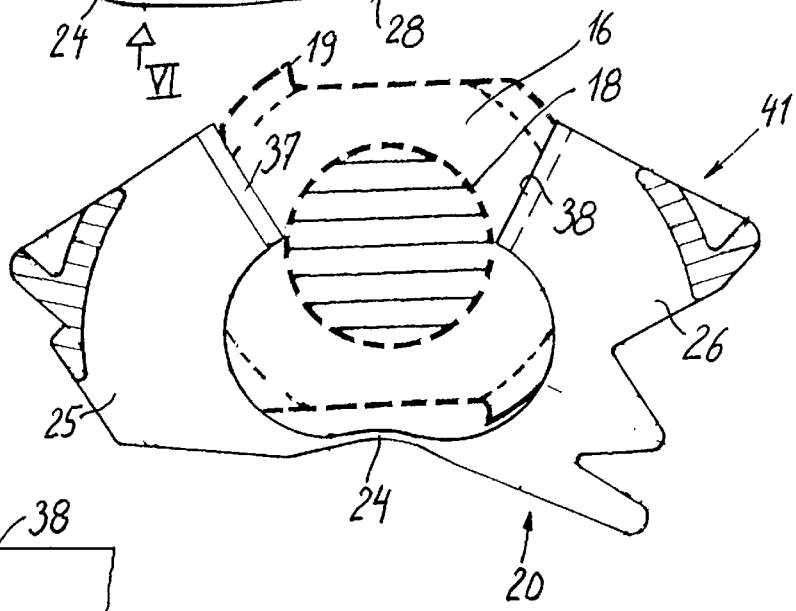
FIG. 4 A cross-section through the stripper block during its assembly.
Figure 5:
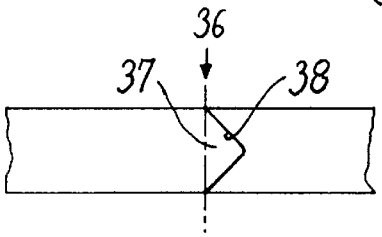
FIG. 5 A larger-scale detail view along line V in FIG. 3.

FIG. 4 shows the stripper during assembly. By means a not shown assembly device it is open to such an extent compared with its production position, which with regards to the opening of the separation point corresponds to FIG. 2, until it is slid over the shaft section 18. It largely snaps together under inherent resilience and is then closed, accompanied by centring by the orientation and engagement parts 37, 38 and subsequently, by sliding into the connecting part 39, is secured and held in the form of a rail in accordance with FIG. 1.

Figure 6:
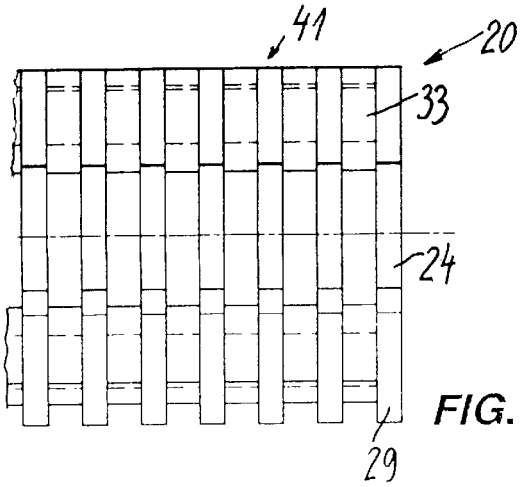
FIG. 6 A partial view of a stripper block in the direction of arrow VI in FIG. 3.
Figure 7:
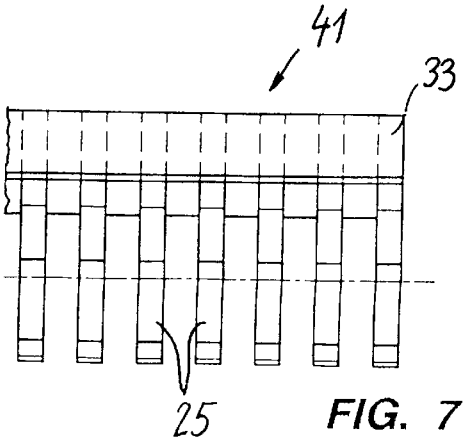
FIG. 7 A view of the stripper block of FIG. 3 in the direction of arrow VII.

FIGS. 6 and 7 show in two views the comb-like construction of the strippers. They can be manufactured as a single plastic injection moulding, so that two identical parts are sufficient for the strippers of one cutting mechanism. As the plastics material can be used a particularly slidable material, which is flexible enough in order to withstand the hinge effect (cf. FIG. 4) in the vicinity of the flexible circumferential portion without the plastics material being damaged.

Figure 8:
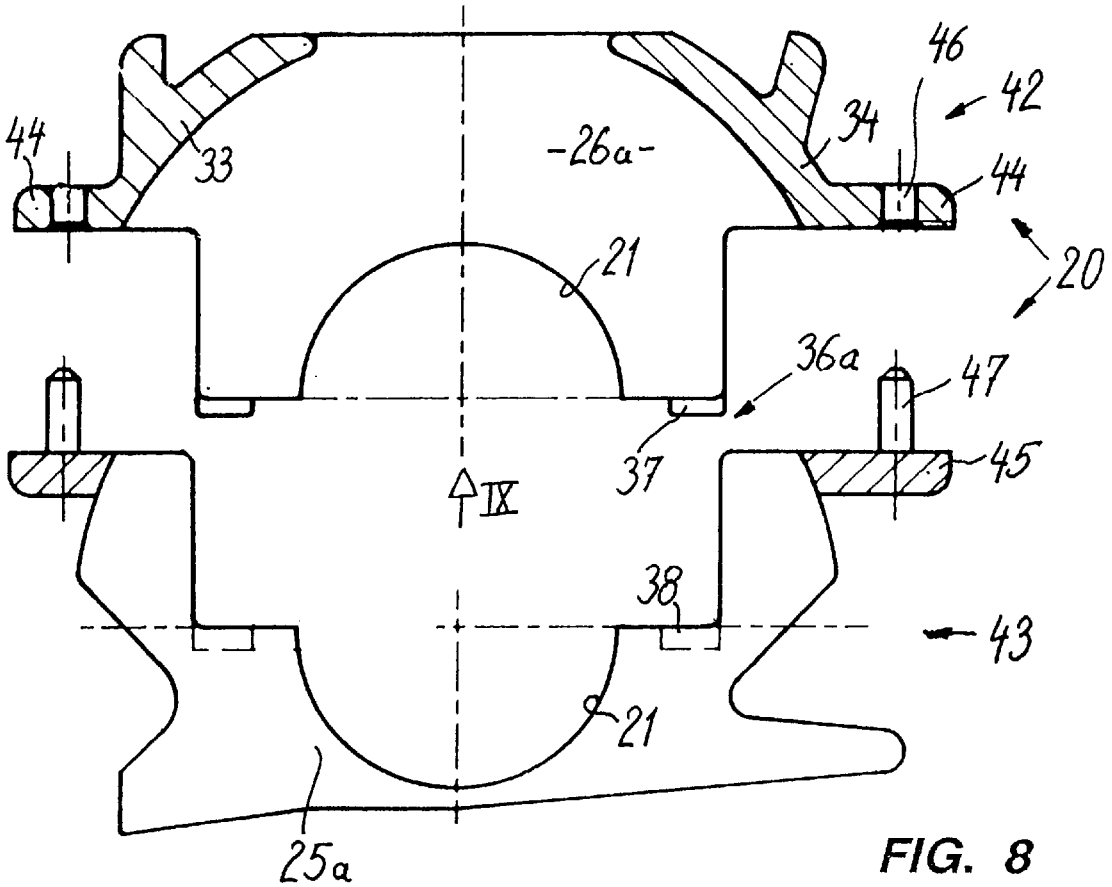
FIG. 8 A cross-section through two partial blocks joined together to form a stripper.
Figure 9:
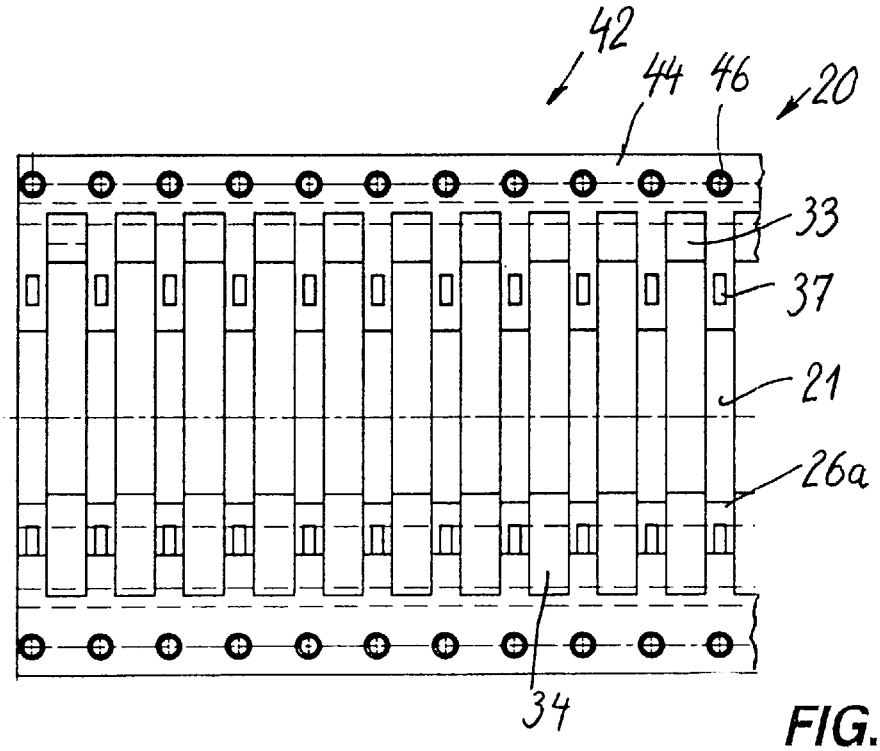
FIG. 9 A partial view of the upper block in FIG. 8 in the direction of arrow IX.

FIGS. 8 and 9 show a construction, in which the stripper is assembled from two partial blocks or half-shells 42, 43 taking up the entire cutting mechanism length or part thereof. With regards to the construction and function, the stripper has the same characteristics as in the preceding description, but here the separation point 36*a* is continuous over the stripper, so that there are two completely separated stripper sections 25*a*, 26*a*. The section 26*a* has the connecting elements 33, 34 which, as described hereinbefore, can be introduced into a connecting part 39. Laterally thereof are provided side flanges 44 with holes 46, on which can engage corresponding side flanges 45 on the sides of the stripper sections 25*a* and pins 47 provided thereon penetrate the holes 46 and mutually centre the two stripper parts. They can then be joined together by melting the pin heads, ultrasonic welding, etc., after being introduced from both sides into the cutting roller gaps.

FIG. 8 shows a view of the half-block 42 carrying the connecting elements from below. In the vicinity of the separation point 36 there are also orientation and engagement elements 37, 38 in the form of projections and depressions, which ensure an equiplanar, mutual orientation of the stripper sections 25, 26.

With this construction it is also possible, also in the case of a one-piece cutting roller, to provide strippers completely engaging round the shaft sections which only comprise a few components and which can be assembled easily and in labour-saving manner. Also when using individual strippers according to FIGS. 1 and 2 assembly is facilitated, because the strippers have integrated spacers. A suitable plastics material for manufacture is POM (polyoxymethylene), which withstands the assembly and operating stresses and has limited friction with respect to steel. As a result of the circular, closed construction not only is the need for stripper edges scraping on the shaft base avoided, but also the structural strength of the stripper is improved.

We claim:

1. Cutting mechanism of a document shredder comprising:

two parallel, cooperating, driven cutting rollers, each cutting roller extending in an axial direction along a longitudinal axis and having several cutting disks spaced along said axis and spaced from each other by disk gaps and shaft sections (18) of the cutting rollers (15);

the cutting disks (16) of each one of the cutting rollers (15) engaging in the disk gap (17) between the cutting disks (16) of another one of the cutting rollers (15);

at least one stripper (20), engaging in the disk gaps (17) and having a stripper opening (21) with an inner surface completely surrounding at least one of the shaft sections (18);

the stripper (20) being fitted to the cutting mechanism by fitting means (39);

the stripper (20) consisting of injection molded plastic material having elastic properties, each stripper having:

two plate-like stripper sections (25, 26), each having a thickness in the axial direction that is smaller than a width of the disk gap (17); and a rim (22) on both axial sides of the stripper adjacent to and completely surrounding the stripper opening (21);

the rim (22) projecting in the axial direction over the plate-like stripper sections (25, 26) for a distance that is greater than the thickness of the plate-like stripper sections and that approximates the width of the disk gaps;

the rim (22) having a radial thickness which is smaller than the axial projection of the rim;

the rim (22) having, at its circumference, a flexible rim section (24), forming an elastic bridge connecting both stripper sections;

the stripper being split by at least one separation gap (36) at its circumference surrounding the shaft section (18), the separation gap (36) being bordered by end faces;

the flexible rim section allowing, by elastic deformation, the separation gap (36) to be widened to a mounting position of the stripper, allowing the stripper to be positioned with its inner circumference over at least one of the shaft sections (18) and allowing the separation gap (36) to be nearly closed in an operation position of the stripper in which operation position the stripper is held by the fitting means (39); and each stripper section (25, 26) having interlocking orientation and engagement elements (37, 38) at the end faces bordering the separation gap (36).

2. Cutting mechanism according to claim 1, wherein the stripper (20) is a one-piece moulded plastic part, the end faces bordering the separation gap (36) are, after moulding, spaced from each other to ease widening the separation gap (36) to engage the stripper over the shaft section (18) and to close the separation gap.

3. Cutting mechanism according to claim 1, wherein the fitting means comprise at least one profiled rail into which fitting elements (33, 34) of the stripper engage.

4. Cutting mechanism according to claim 1, wherein the flexible section is restricted in its radial extension to the thickness of the rim.

5. Cutting mechanism according to claim 1, wherein each stripper comprises stripper sections (25, 26) engaging in only one disk gap (17) and spacer elements (33, 34) for contacting adjacent strippers, the spacer elements having fitting elements (35) to engage the fitting means (39).

6. Cutting mechanism according to claim 5, wherein a spacer element is provided on each side of the separation gap (36).

7. Cutting mechanism according to claim 1, wherein a passage (23) is defined between the cutting rollers (15), and the flexible section of the stripper is situated adjacent to the passage.

8. Cutting mechanism according to claim 1, wherein the plate-like stripper sections (25, 26) project radially over an outer circumference of the cutting disks.

9. Cutting mechanism according to claim 1, wherein bi-laterally of the separation gap (36) are provided outwardly projecting arms (29, 30), which form levers for opening the separation gap (36).

10. Cutting mechanism of a document shredder comprising;

two parallel, cooperating, driven cutting rollers, each cutting roller having several cutting disks, being axially spaced from each other by disk gaps and shaft sections (18) of the cutting rollers (15);

the cutting disks (16) of each one of the cutting rollers (15) engaging in the disk gap (17) between the cutting disks (16) of the other one of the cutting rollers (15);

several strippers (20), engaging in the disk gaps (17) and each having a stripper opening (21) with an inner surface completely surrounding one of the shaft sections (18);

the strippers (20) being fitted to the cutting mechanism by fitting means (39);

each stripper being split in two stripper halves by separation gaps (36) at its circumference surrounding the shaft section (18), the separation gaps (36) being bordered by end faces;

several axially successive stripper halves being combined to a block (41, 42, 43) extending axially to the cutting roller (16) and manufactured in one piece by plastic injection moulding in the manner of two assemblable half-shells (42, 43);

the stripper halves of each block being interconnected by two connecting webs (33, 34, 45) each located on either side of the separation gaps (36), which connecting webs have engagement faces for fitting means (39) fitting the stripper block to the cutting mechanism;

each block having, at its end faces bordering the separation gaps, first interlocking orientation and engagement elements; and each stripper halve of a block also having, at its end faces bordering the separation gap (36), second interlocking orientation and engagement elements (37, 38) interlocking and orienting each plate-like stripper halve to an adjacent stripper halve of an adjacent stripper block of the same cutting roller.

* * * * *